US008403166B2

(12) United States Patent
Steininger

(10) Patent No.: US 8,403,166 B2
(45) Date of Patent: Mar. 26, 2013

(54) SEALABLE STORAGE CONTAINER

(75) Inventor: Jeff Steininger, St. Mayer's, OH (US)

(73) Assignee: Zak Designs, Inc., Spokane, WA (US)

( * ) Notice: Subject to any disclaimer, the term of this patent is extended or adjusted under 35 U.S.C. 154(b) by 71 days.

(21) Appl. No.: 13/134,155

(22) Filed: May 31, 2011

(65) Prior Publication Data

US 2012/0305558 A1 Dec. 6, 2012

(51) Int. Cl.
*B65D 53/00* (2006.01)

(52) U.S. Cl. ..... 220/235

(58) Field of Classification Search ..... 220/235, 220/234, 233, 238, 254.9, 254.8, 254.1, 259.5, 220/345.6, 345.1, 200; 215/270, 360, 358, 215/355, 228, 200; *B65D 53/00*
See application file for complete search history.

(56) References Cited

U.S. PATENT DOCUMENTS

| | | | | |
|---|---|---|---|---|
| 1,929,498 | A | 10/1933 | King | |
| 2,016,224 | A * | 10/1935 | Bukolt | 220/295 |
| 2,462,445 | A * | 2/1949 | Weiss | 215/262 |
| 3,335,895 | A | 8/1967 | Santarelli | |
| 3,606,070 | A * | 9/1971 | Shepard | 220/210 |
| 4,648,528 | A | 3/1987 | LaBarge et al. | |
| 5,397,000 | A | 3/1995 | Holte et al. | |
| 5,881,908 | A * | 3/1999 | Hays et al. | 220/669 |
| 5,979,690 | A | 11/1999 | Hartley | |
| 2008/0314775 | A1 | 12/2008 | Owoc | |
| 2009/0308765 | A1 | 12/2009 | Smith et al. | |
| 2010/0133285 | A1 | 6/2010 | Schepen et al. | |

OTHER PUBLICATIONS

PCT Search Report.

* cited by examiner

*Primary Examiner* — Jacob K Ackun
*Assistant Examiner* — Robert J Hicks
(74) *Attorney, Agent, or Firm* — Paine Hamblen, LLP

(57) ABSTRACT

A sealable storage container is described and which includes a container bottom having a continuous sidewall, a container lid for mating cooperation with a container bottom; a rotatable member received in, and cooperating with the container lid; a moveable pressure plate cooperating with the rotatable member; and a resilient sealing member mounted on a moveable pressure plate and extending in the direction of the container lid, and wherein rotation of the rotatable member causes the resilient seal to deform, at least in part, laterally outwardly so as to releasably sealably engage the container bottom to affect sealable attachment of the container lid to the container bottom.

12 Claims, 11 Drawing Sheets

SEALABLE STORAGE CONTAINER

TECHNICAL FIELD

The present invention relates to a sealable storage container and the like, and more specifically to a sealable storage container which may be readily and easily disassembled for cleaning, maintenance and the like, and which is further useful for storing food products which may have a liquid or flowable component.

BACKGROUND OF THE INVENTION

Various storage containers have been designed, through the years, for various end uses. Increasingly, designers of such houseware products have attempted to provide storage containers which are, on the one hand, aesthetically appealing, and on the other hand provide a convenient means for safely storing various food stuffs in pantries, kitchens and other food preparation areas.

As of late, designers of such houseware products have endeavored to create storage containers which provide the ability to not only store food in bulk, but also to store the same food items for longer periods of time. In this regard, several manufacturers have attempted to provide stackable, airtight storage containers for storing dry food products over prolonged periods of times. Manufacturers such as OXO International have sold dry storage containers under such trademarks as the OXO Good Grips Pop Container™ and which provides a clear storage container having a removable, substantially airtight lid which is activated by a push button latch assembly that is located in the central portion thereof. This product includes on its container lid a circumscribing silicone seal, which matingly engages the sidewall of the storage container when the push button latch is depressed so as to substantially seal the dry food product within the storage container.

Another example of a commercially available food storage container of similar design is marketed under the trademark "Gourmet Living" and which is sold and distributed by Shopko Stores Operating Company LLC of Greenbay, Wis. Again, this substantially clear storage container includes a removable lid having a circumscribing silicone seal which, when urged outwardly by a pressure plate which is provided with the container lid, engages the sidewall of the storage container so as to provide a substantially airtight seal.

While each of the aforementioned commercially available products have operated with varying degrees of success, shortcomings attributable to their design have detracted from their usefulness. Chief among the defects in the designs mentioned, above, relate to the complexity of the overall design, and their relative inability to be adequately cleaned in the event that the product is used to store a liquid food product. In the case of the OXO International product described, above, the push button latch mechanism is complex in its overall design, and includes some mechanical features which cannot be readily disassembled, and cleaned by a user of the product. Still further with the earlier mentioned container marketed under the trademark "Gourmet Living," it includes a moveable pressure plate, and an expandable silicone gasket which cannot be readily detached from the container top and cleaned. In view of these design deficiencies, both manufacturers have clearly indicated in their packaging instructions to the consumer that the container is to be used only for dry food storage.

It has long been recognized that long term food storage for food products having liquid or other fluid components is desirable. However, no particular design of an airtight storage container and easily removable lid has emerged that provides a means for the convenient storage of food components having liquid portions, or components, and which further can be readily disassembled so as to allow a user thereof to adequately clean the component pieces thereof so as to prevent the growth of harmful bacteria, and to remove food debris and other particulate matter, and the like, following its usage.

Therefore, a sealable storage container which addresses the shortcomings attendant with the prior art practices, and designs employed, heretofore, is the subject matter of the present invention.

SUMMARY OF THE INVENTION

A first aspect of the present invention relates to a sealable storage container which includes a container bottom having an upstanding, and continuous sidewall which defines an aperture which allows access to the container bottom; a container lid for mating cooperation with the container bottom, and which further has an aperture form therein, and which extends therethrough; a rotatable member received in the aperture defined by the container lid; a movable pressure plate threadably cooperating with the rotatable member, and wherein a clockwise rotation of the rotatable member moves the pressure plate in the direction of the container lid, and a counter-clockwise rotation of the rotatable member moves the pressure plate away from the container lid; and a resilient seal is mounted on the movable pressure plate, and which extends in the direction of the container lid, and wherein the clockwise rotation of the rotatable member causes the resilient seal to engage the container lid, and then deform, at least in part, laterally, outwardly, so as to releasably, sealably engage the upstanding continuous sidewall of the container bottom to effect the sealable attachment of the container lid to the container bottom.

Still another aspect of the present invention relates to a sealable storage container which includes, a container bottom defining a cavity for receiving an object of interest, and wherein the container bottom includes a bottom surface with a peripheral edge, and a continuous sidewall extends upwardly from the peripheral edge of the bottom surface, and which further has a top peripheral edge defining a container bottom aperture which allows the object of interest to be placed within the cavity of the container bottom; a container lid for cooperating with the container bottom, and which further occludes the container bottom aperture, and wherein the container lid has a top and bottom surface, and an aperture is formed therein, and which extends between the top and bottom surfaces, and wherein at least one orientation member is mounted on the bottom surface, and depends downwardly therefrom, and which further defines an internal channel; a rotatable member received within the aperture formed in the container lid, and wherein the rotatable member includes a threaded shaft portion extending through the aperture defined by the container lid, and a hand-engageable portion affixed to the threaded shaft portion, and which rests on the top surface of the container lid; a moveable pressure plate oriented in spaced relation relative to the bottom surface of the container lid, and wherein the moveable pressure plate has a top surface which is juxtaposed relative to the bottom surface of the container lid, an opposite bottom surface, and a peripheral edge, and wherein a threaded channel is mounted on the top surface of the movable pressure plate, and is sized so as to threadably receive and matingly cooperate with the threaded shaft of the rotatable member, and wherein the clockwise rotation of the rotatable member threadably advances the moveable pressure plate in the direction of the container lid, and the counter-clockwise rotation of the rotatable member effects movement of the moveable pressure plate away from the container lid, and wherein an orientation post is mounted on the top surface of the pressure plate, and is sized so as to be slideably received in the orientation member which is mounted on the bottom surface of the container lid; and a resilient, substantially continuous sealing member which has an inside peripheral edge which sealably engages the peripheral edge of the moveable pressure plate, and which further has an outside peripheral edge which extends in the direction of the bottom surface of the container lid, and wherein, the container lid, when placed in an occluding relationship relative to the aperture defined by the container bottom, and the rotatable member is rotated in a clockwise direction, the moveable pressure plate travels in the direction of the container lid and causes the resilient substantially continuous sealing member to forcibly engage the bottom surface of the container lid and then resiliently deform, at least in part, substantially laterally and outwardly so as to seal the engaged continuous sidewall which defines, at least in part, the container bottom so as to effectively sealably secure the container lid to the container bottom.

These and other aspects of the present invention will be discussed in greater detail hereinafter.

BRIEF DESCRIPTION OF THE DRAWING

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent laws "to promote the progress of science and useful arts." (Article I, Section 8).

Figure 1:
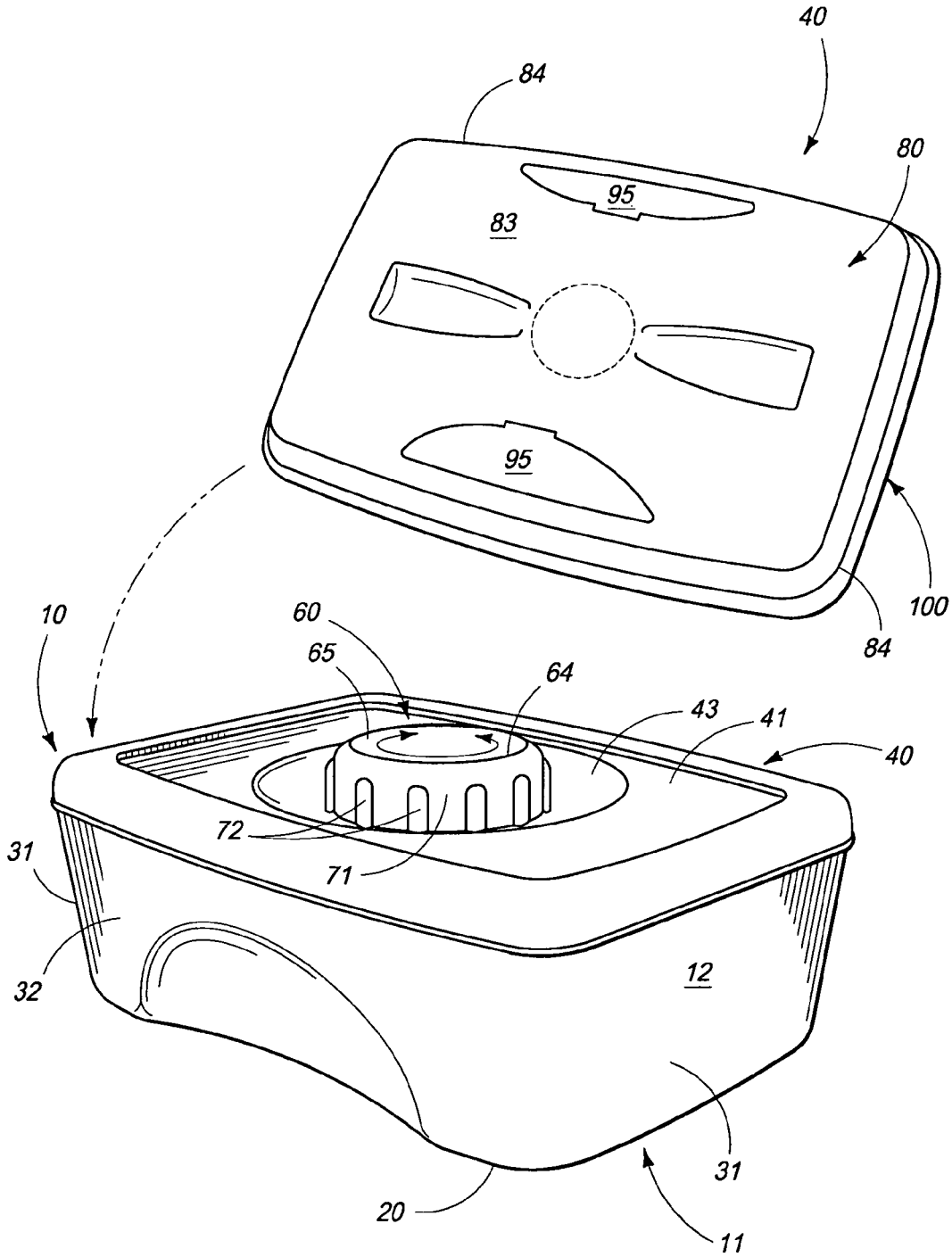
FIG. 1 is a perspective side elevation view of the sealable storage container of the present invention.
Figure 2:
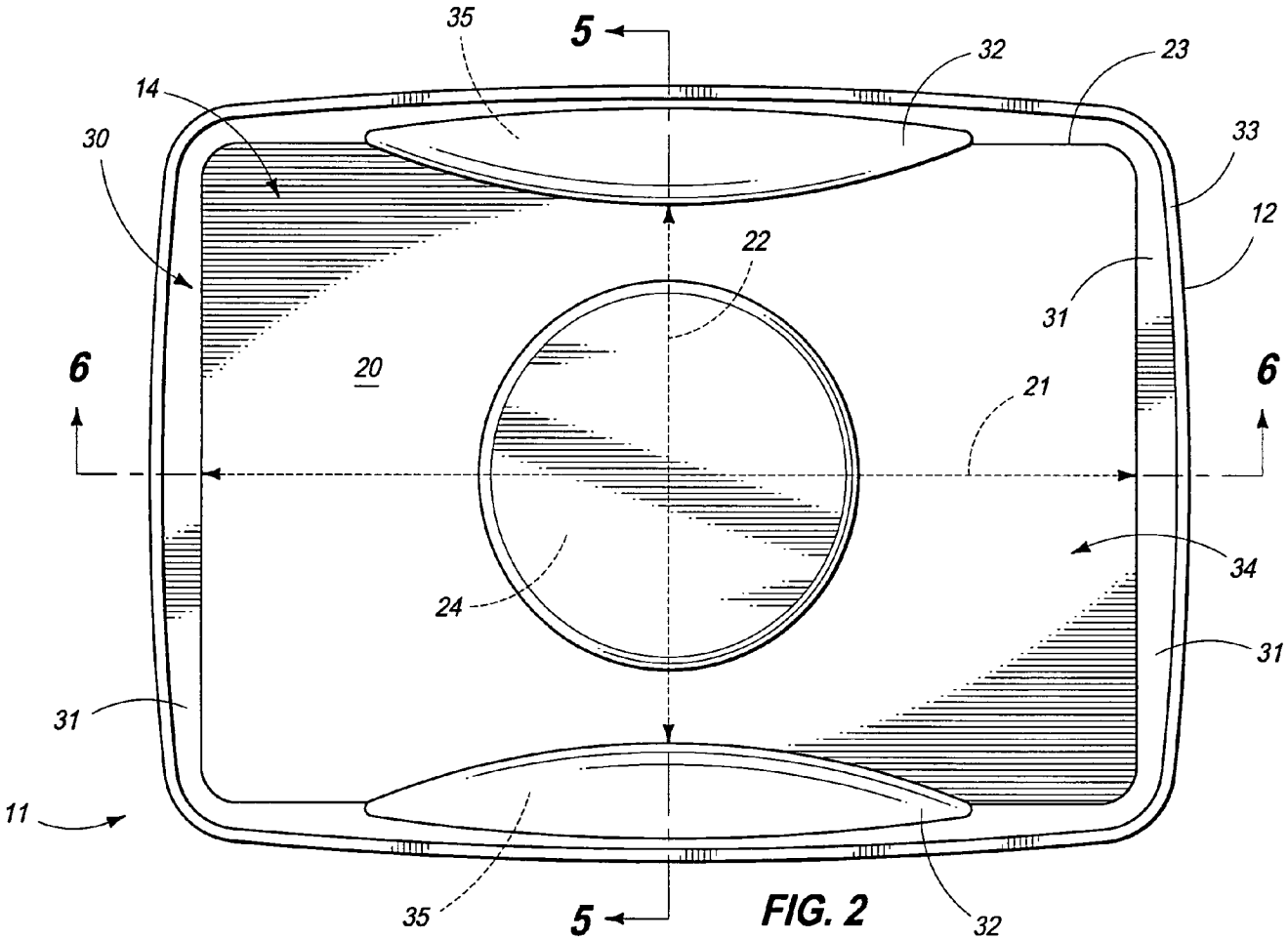
FIG. 2 is a top, plan view of the container bottom and which forms a feature by the present invention.
Figure 3:
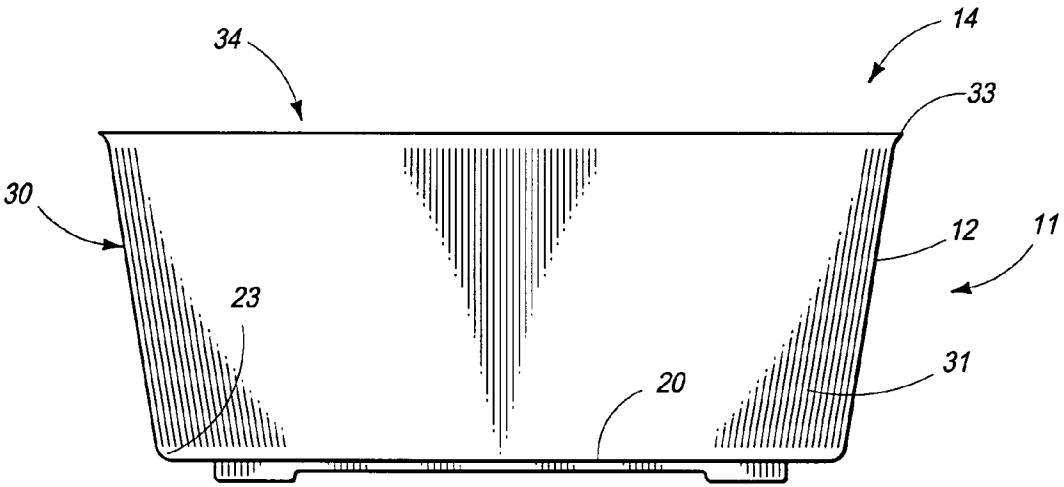
FIG. 3 is a side elevation view of one end of the container bottom which forms a feature of the present invention.
Figure 4:
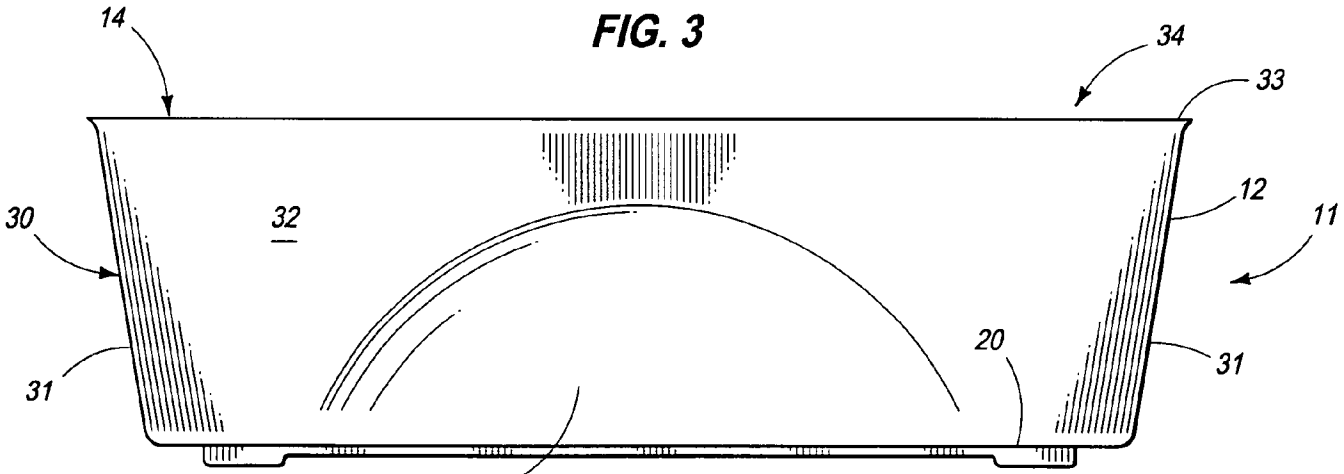
FIG. 4 is a side elevation view of one side of the container bottom which forms a feature of the present invention.
Figure 5:
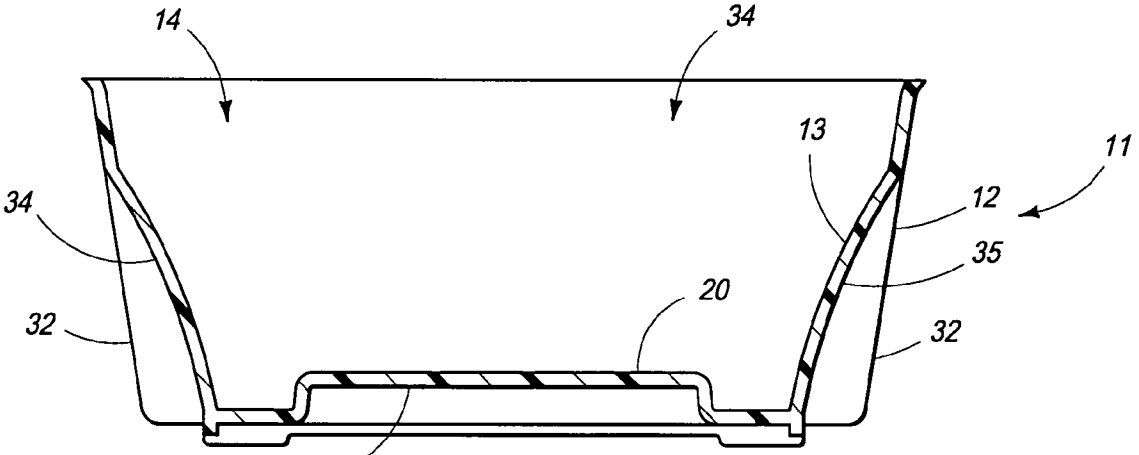
FIG. 5 is a transverse, vertical sectional view taken from a position along line 5-5 of FIG. 2.
Figure 6:
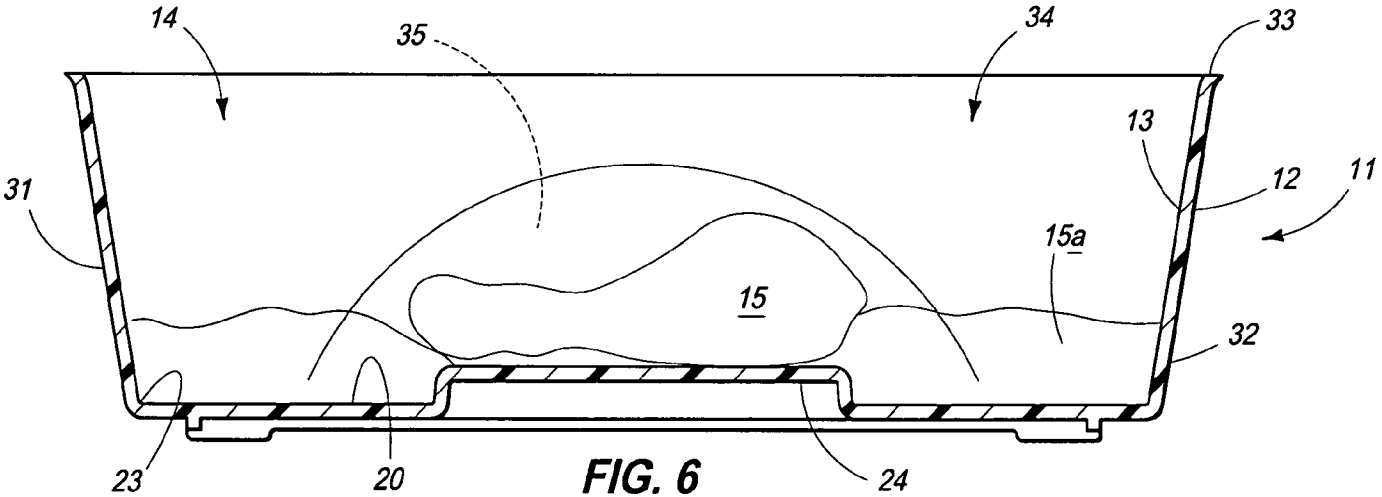
FIG. 6 is a longitudinal, vertical sectional view taken from a position along line 6-6 of FIG. 2.
Figure 7:
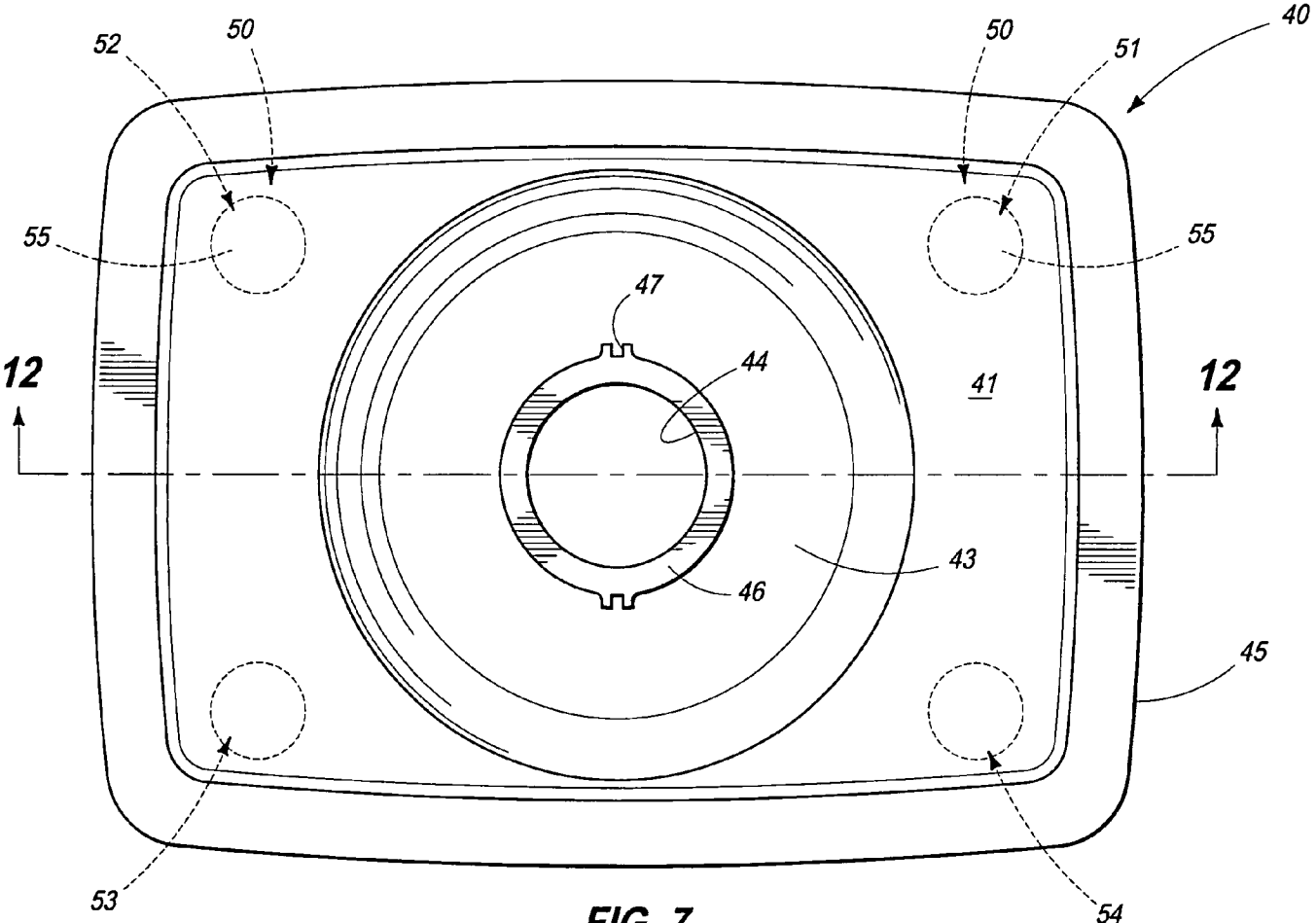
FIG. 7 is a top, plan view of the container lid which forms a feature of the present invention.

Referring now to FIG. 1, and following, the sealable storage container of the present invention is generally indicated by the numeral 10 therein (FIG. 1). The sealable storage container 10 includes a container bottom or portion 11 which is typically fabricated of a thermal-moldable plastic or other synthetic material. However, the principals of the present invention would also work equally well with other ridged substrates such as stainless steel; glass, and the like. The container bottom 11 has an outside facing surface 12, and opposite inside facing surface 13. The inside facing surface 13 defines an internal cavity 14 having given dimensions. The internal cavity 14 can receive for storage a number of different objects of interest which may include assorted food stuffs. The object of interest such as food stuff 15 may have a watery or fluid component 15A which is contained within the cavity 14. The object of interest 15 may also be entirely fluid such as a soup, for example. As seen in the drawings, the sealable storage container 10, and more specifically the container bottom portion thereof 11, has a bottom surface which is generally indicated by the numeral 20. The bottom surface has a substantially uniform length dimension that is indicated by the line labeled 21, and a nonuniform width dimension that is generally indicated by the numeral /22. Additionally, the bottom surface 20 has a peripheral edge 23. The container bottom 11 further has a cavity 24 formed in the outside facing surface 12 of the bottom surface 20. This cavity is used to enhance the strength characteristics of the bottom surface 20.

The container bottom 11 has an upstanding, substantially continuous sidewall which is generally indicated by the numeral 30. The upstanding continuous sidewall 30 extends from the peripheral edge 23 of the bottom surface 20, and generally upwardly to form the main body of the container bottom 11. The continuous sidewall 30 is formed of a pair or oppositely positioned, and substantially planar end walls which are generally indicated by the numeral 31. Further, the continuous sidewall 30 has a pair of oppositely positioned and non-planar sidewalls that are generally indicated by the numeral 32. The upstanding, continuous sidewall 30 also includes an uppermost peripheral edge 33 which defines an aperture 34 which allows access to the container bottom 11, and more specifically to the internal cavity 14 thereof. It is through this aperture 34 that the objects of interest 15, which may be a food stuff, of various types, enters and exits the sealable storage container 10. As seen in the drawings, a concavely shaped cavity 35 is formed in the lateral sidewalls 32. This concavely shaped cavity increases the strength of the continuous sidewall 30, and also provides a convenient means for a user to manipulate or otherwise hold, or grasp, the sealable storage container 10.

Figure 12:
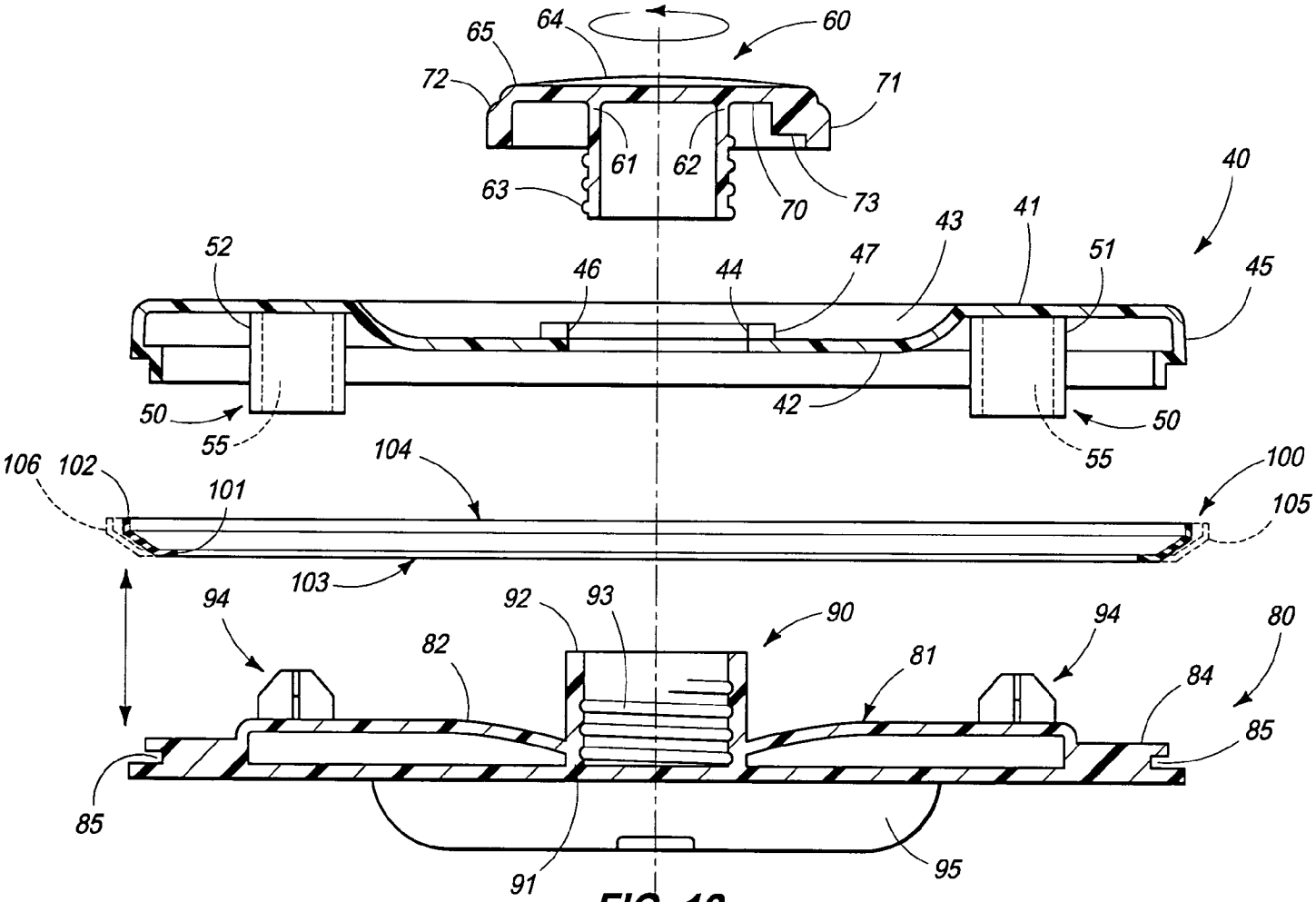
FIG. 12 is an exploded, transverse vertical sectional view of the container lid, pressure plate, and sealing member, all of which forms a feature of the present invention.

The sealable storage container 10 of the present invention includes a removable container lid 40 (FIG. 12) which is operable to sealably mate with the container bottom 11 as described in the paragraphs, above. The container lid 40 is operable to sealably occlude the aperture 34 which is defined by the upstanding continuous sidewall 30. Further, the container lid 40 is operable to sealably mate thereagainst the inside facing surface 13 of the container bottom 11 (FIG. 1). The container lid 40, as seen in the drawings, has a top surface 41, and an opposite bottom surface 42. Still further, as seen in the illustrations that are provided, a concave shaped cavity 43 is formed substantially centrally of the top surface 41. Formed substantially centrally of the concave cavity 43 is a circular aperture 44 which has a predetermined diametral dimension, and which extends between the top surface 41, and the opposite, bottom surface 42. Still further as seen in the drawings, the container lid 40 has a circumscribing and depending peripheral edge or sidewall 45. This peripheral edge or sidewall is rounded, for safety purposes, and to further increase the aesthetic appearance of the resulting product. As seen in the drawings, an elevated and circumscribing wall, or neck portion 46 is made integral with the top surface 41 of the container lid 40. The neck portion 46 has an outside peripheral surface which has an engagement member 47 affixed thereto. This engagement member 47 cooperates with a rotatable member which will be more fully described in the paragraphs which follow.

Figure 8:
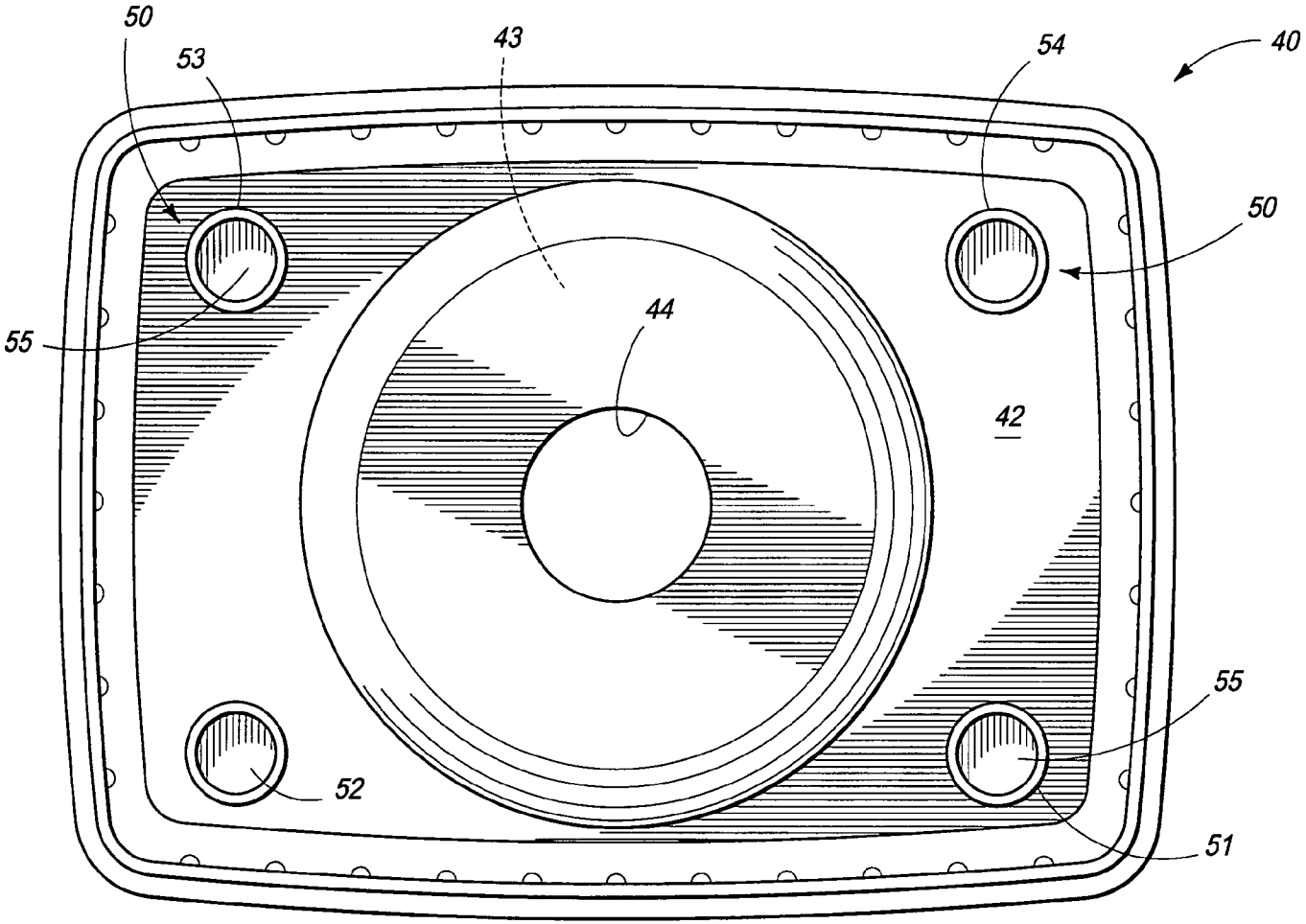
FIG. 8 is a bottom plan view of the container lid which forms a feature of the present invention.
Figure 9:
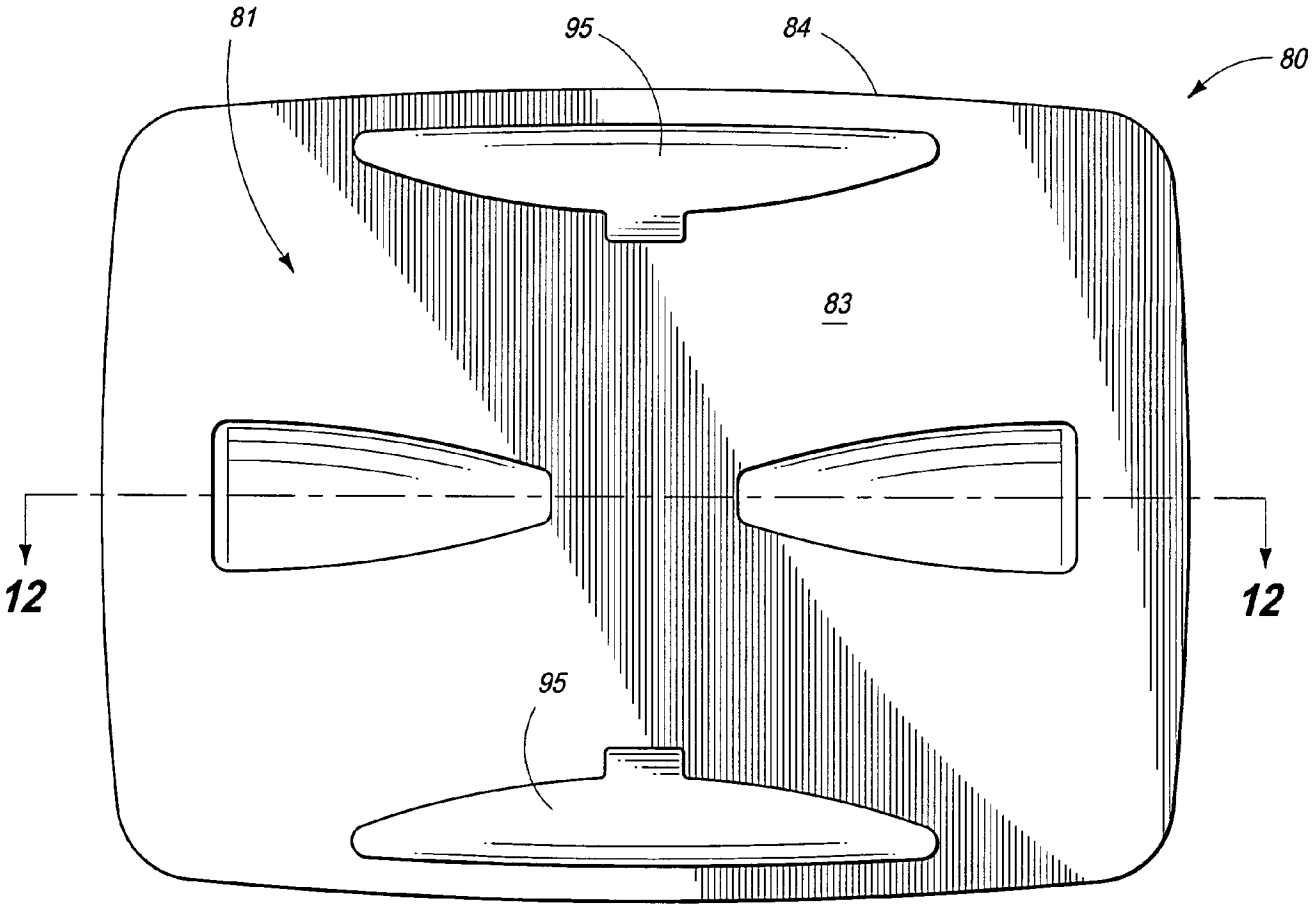
FIG. 9 is a bottom plan view of a pressure plate which forms a feature of the present invention.
Figure 10:
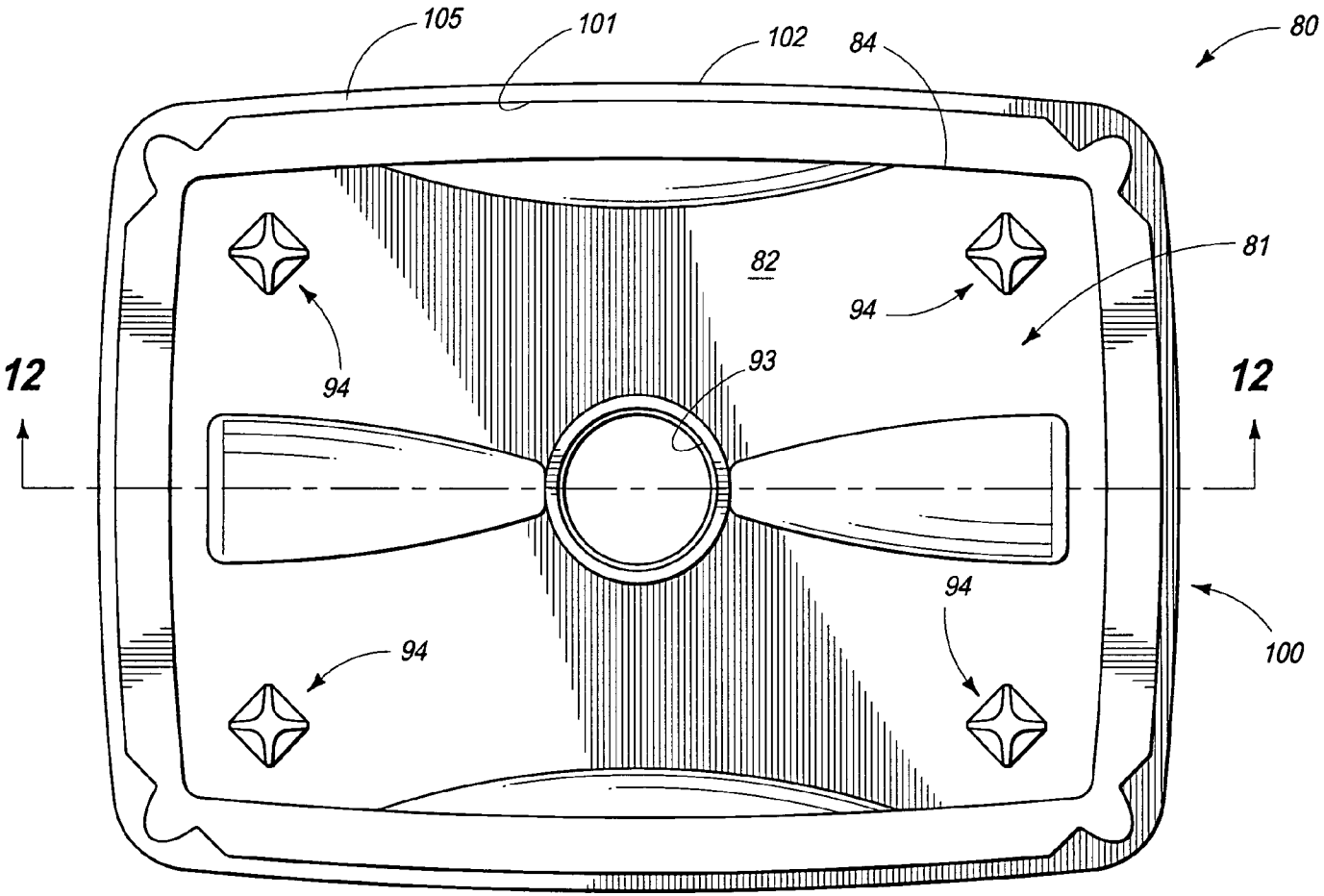
FIG. 10 is a top plan view of the pressure plate which forms a feature of the present invention.

Referring again back to the drawings (FIGS. 8 and 12), and more specifically to the container lid 40, it will be seen that the bottom surface 42, thereof, includes a multiplicity of orientation members which are generally indicated by the numeral 50. The orientation members as seen in the drawings are identified as first, second, third and fourth orientation members 51 through 54, respectively. The respective orientation members 50 are placed in predetermined spaced relationship relative to the aperture 44, and which is formed substantially centrally of the container lid 40. Each of the respective orientation members 51 through 54 respectively define an internal, longitudinally oriented channel 55 having a predetermined depth and diametral dimension. These orientation members 50 are operable to define, at least in part, a course of movement for a pressure plate, which will be described in greater deal in the paragraphs which follow.

As seen in the drawings (FIG. 12) the sealable storage container 10 includes a rotatable member 60 which is received in and through the aperture 44, and which is formed substantially centrally of the container lid 40. The rotatable member 60 includes a threaded shaft portion 61 which has a first end 62, and an opposite, second, or distal end 63. Further, the rotatable member 60 includes a hand-engageable portion 64 which is substantially circular in shape, and which has a top surface 65, and a bottom surface 70, which is affixed to the first end 62 of the threaded shaft 61. As illustrated, the hand-engageable portion 64 is positioned or oriented substantially transversely relative to the longitudinal axis of the threaded shaft 61. The bottom surface 70 of the hand-engageable portion 64 rests, on or is closely juxtaposed relative to, the top surface 41 of the container lid 40, and it is located within the concave cavity 43 that is formed therein. The hand-engageable portion 64, and more specifically the top surface 65 thereof includes a depending, peripheral edge or sidewall 71. As seen in the drawings, a multiplicity of spaced, gripping protrusions or ribs 72 are formed at predetermined, spaced locations along the peripheral edge 71, and provide a convenient means for a user to impart force by means of their fingers to the peripheral edge 71 so as to cause predetermined rotational movement to the attached threaded shaft 61. This rotational movement may be either in a clockwise direction, or a counterclockwise direction. The clockwise rotational movement is effective in causing the container lid 40 to be effectively sealed in an occluding relationship relative to the container bottom 11 as will be discussed in greater detail in the paragraphs which follow. Additionally, it will be seen in the drawings that an engagement member 73 is molded, formed or otherwise attached to the peripheral edge or sidewall 71. This engagement member faces inwardly relative to the peripheral edge 71. The engagement member 73 is operable to forcibly engage or interact with the member 47 which is made integral with the elevated neck portion 46. Upon application of a sufficient rotational force, these engagement members may pass by each other to allow continued rotation of the threaded shaft 61. This feature provides a convenient tactile signal to a user regarding the amount of rotational movement of the member and the state of the sealing of the container lid 40. Further this feature prevents the accidental loosening of the container lid 40.

It will be seen clearly in the drawings (FIG. 12) that the sealable storage container 10 of the present invention also further includes a moveable pressure plate 80 which threadedly cooperates with the threaded shaft 61, and is reciprocally moveable both towards, and away from, the bottom surface 42 of the container lid 40, as will be described in greater detail, below. The moveable pressure plate 80 has a main body 81 which has a top surface 82 which is juxtaposed relative to the bottom surface 42 of the container lid 40, when it is assembled, and further has an opposite bottom surface 83. Still further the main body 81 includes a peripheral edge 84 which has formed therein a circumscribing channel 85 which is operable to matingly receive, and otherwise cooperate with a resilient sealing member as will be discussed in greater detail, below. Additionally, it will be seen from the drawings that a threaded channel 90 is mounted substantially centrally of the top surface 82, and extends normally, upwardly, relative thereto. The threaded channel has a first end 91 which is affixed to the top surface 82, and further has a distal, second end 92, which is operable to be received within, or coaxially aligned with the aperture 44 that is formed in the container lid 40. It will be understood from the drawings that the outside diametral dimension of the second end 92 is less than the diametral dimension of the aperture 44 which is formed in the container lid 40. As illustrated in the drawings, a threaded passage way 93 is formed therein, and which is operable to threadably receive and cooperate with the threaded shaft portion 61 of the rotatable member 60. It will be understood that a given rotational movement of threaded shaft causes the pressure plate 80 to move either towards, or away from, the container lid 40 as will be described below. Additionally, a multiplicity of orientation posts 94 are mounted on the top surface 82 and are substantially coaxially aligned with the individual channels 35 which are defined by the respective orientation members 50. The respective orientation posts are operable to be slideably received within the aforementioned channels 55 that are defined by the orientation members 50. The slideable, mating cooperation of these two assemblies (50 and 94) allows the pressure plate 80 to move along a substantially linear path of travel both towards, and away from, the container lid 40. Referring still to drawings it will be seen that the moveable pressure plate 80 includes a pair of downwardly depending container engagement members 95 which are mounted on the bottom surface 83 of the pressure plate 80 and which cooperate with the container bottom 11, and more specifically that region of the container bottom, which corresponds with the concavely formed surfaces 35 that are formed in the oppositely positioned non-planar sidewalls 32 as earlier discussed.

Figure 11:
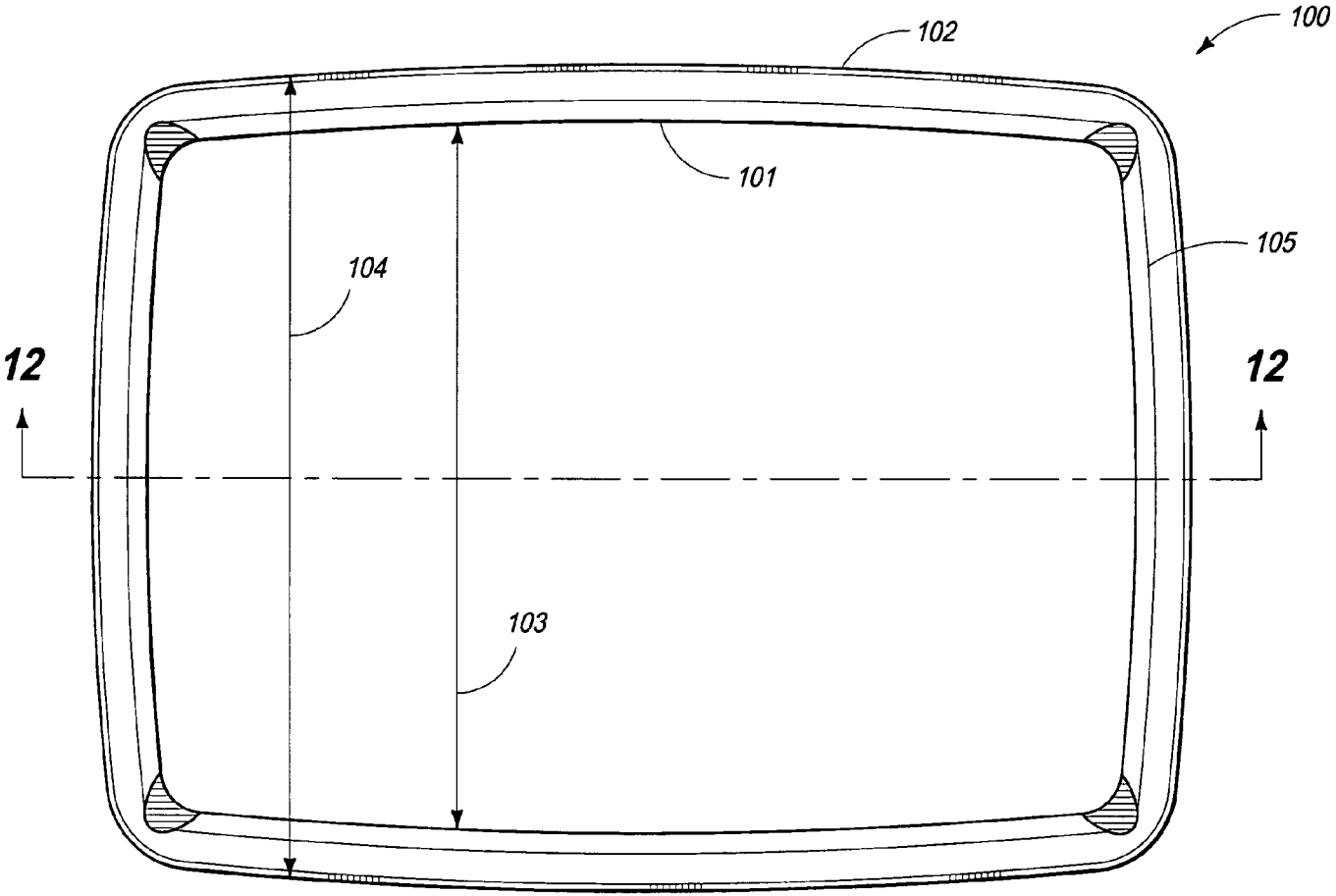
FIG. 11 is a top plan view of the resilient sealing member which forms a feature of the present invention.
Figure 13A:
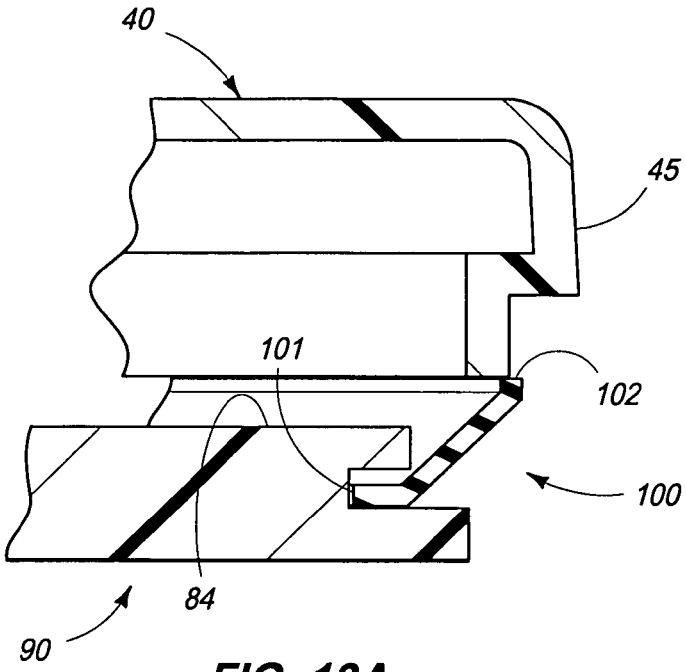
FIGS. 13A and 13B are fragmentary enlarged, transverse, vertical sectional views which show the movement of the sealing member between a first position (FIG. 13A) and a sealed, extended position (FIG. 13B).
Figure 13B:
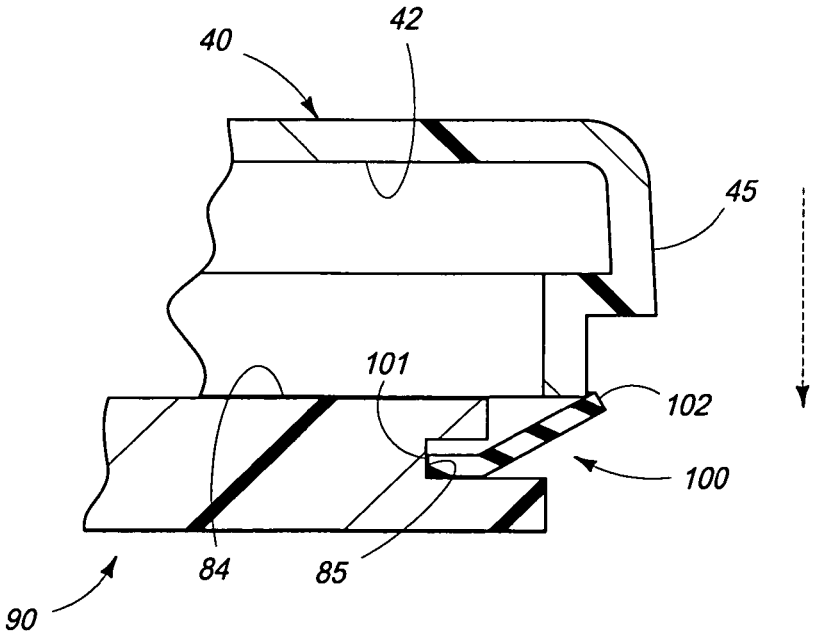

The sealable storage container 10 of the present invention includes a resilient substantially continuous sealing member 100 which is received, at least in part, within the circumscribing channel 85 which is formed in the peripheral edge 84 of the moveable pressure plate 80, and which extends laterally outwardly therefrom. As seen in the drawings (FIG. 11), the resilient sealing member 100 extends in the direction of the container lid 40 (FIG. 12), and in operation, the clockwise rotation of the rotatable member 60 causes the resilient sealing member to engage the container lid 40, and then deform, at least in part, laterally, outwardly 106 so as to releasably, sealably engage the continuous sidewall 30 of the container bottom 11 so as to effect the sealable attachment or coupling of the container lid 40, to the container bottom 11 in a manner not possible, heretofore. As seen in the drawings (FIG. 11 and FIGS. 13A and B), the resilient substantially continuous sealing member 100 has an inside peripheral edge 101, and an outside peripheral edge 102. The inside peripheral edge is operable to be matingly, sealingly received, as earlier discussed, in the circumscribing channel 85 which is formed in the peripheral edge 84 of the moveable pressure plate 80. Additionally, and as seen in the drawings, it will be understood that an aperture 103 of given dimension is defined by the inside peripheral edge 101. Additionally, a second aperture 104 is formed by the outside peripheral edge 102. As will be recognized in the drawings, the aperture 103 is smaller than aperture 104. It will be recognized therefore that the sealing member 100 extends laterally outwardly relative to the peripheral edge 84 of the moveable pressure plate 80, and in direction of the bottom surface 42 of the container lid 40. Additionally, it will be recognized that the continuous sealing member 100 includes an intermediate portion 105. In operation, the outside peripheral edge 102, when it engages the bottom of the container lid 40 gets moved into an outwardly disposed and increasingly angular position which causes it to flare into sealable engagement, so as to allow the resilient seal thereagainst the inside facing surface 13 of the container bottom 11 thereby effecting a seal which is substantially fluid impervious. This is best understood by studying FIGS. 13A and 13B, respectively. This sealing arrangement is advantageous inasmuch as the known prior art devices have not been able to accommodate the storage of food or other objects of interest 15 which have a fluid component because of the possibility that bacterial or other contamination may result from the fluid component coating the structures employed for making the sealing of the lid to the container bottom 11.

Operation

The operation of the described embodiment of the present invention is believed to be readily apparent as briefly summarized to this point.

In its broadest aspect the present invention relates to a sealable storage container 10 which includes a container bottom 11 having an upstanding continuous sidewall 30 which defines an aperture 34, and which allows access to the container bottom 11. The invention also disclose a container lid 40 for mating cooperation with the container bottom 11 and which further has an aperture 44 formed therein, and which extends therethrough. The invention also includes a rotatable member 60 which is received in the aperture 44 and which is defined by the container lid 40. In addition to the foregoing, a moveable pressure plate 80 is provided, and which threadably cooperates with a rotatable member 60, and wherein a clockwise rotation imparted to the rotatable member 60 moves the pressure plate 80 in the direction of the container lid 11, and a counterclockwise rotation of the rotatable member 60 moves the moveable pressure plate 80 away from the container lid 11. Finally, the present invention 10 includes a resilient sealing member 100 which is mounted on the moveable pressure plate 80, and which extends in the direction of the container lid 40. The clockwise rotation of the rotatable member 60 causes the resilient sealing member 100 to engage the container lid 40 and then resiliently deform, at least in part, laterally outwardly so as to releasably sealably engage the continuous sidewall 30 of the container bottom 11 to effect the sealable attachment of the container lid 40 to the container bottom 11.

As seen in the drawings, it will be appreciated that the storage container 10 as described herein may be easily disassembled so it can be inspected, washed, and sanitized as required. Additionally, it will be recognized from the drawings that the container lid 40 as earlier described, is provided with an elevated neck portion 46. Further, the hand-engageable portion 64 of the rotatable member 60 has an inside facing surface with a member 47 which matingly and/or forcibly engages the elevated neck portion 46 which surrounds the aperture 44. This forcible engagement provides a means by which the user of the sealable storage container 10 can conveniently determine, in a tactile fashion, the amount of the threadable advancement of the threaded shaft 61 into the threaded channel 90, and which is incorporated or made integral with the moveable pressure plate 80. As will be recognized, as the rotatable member 60 is turned in a clockwise direction, the pressure plate 80 moves in a substantially linear direction towards the container lid 40 thereby causing the deformation of the resilient sealing member 100. This linear movement is caused and effected by the mechanical cooperation of the respective orientation members 51-54, in combination with the multiplicity of orientation post 94, and which coaxially slideably cooperate with, and in, the internal channels 55 that are defined by the respective orientation members 50.

Therefore, it will be seen that the present invention 10 provides a convenient means for providing a sealable storage container which has operational attributes and features not present in the prior art devices utilized, heretofore. The present invention avoids the shortcomings attendant with the prior art devices, and provides a convenient easily disassembled sealable storage container which may be utilized for storing various food products including foods products that may have a liquid component and which is easily open, and sealably closed in a convenient manner.

In compliance with the patent statute, the invention has been described in language more or less specific as to structural and methodical features. It is to be understood, however, that the invention is not limited to the specific features shown and described, since the means herein disclosed compromise preferred forms of putting the invention into effect. The invention is, therefore, claimed in any of its forms or modifications within the proper scope of the appended claims appropriately interpreted in accordance with the Doctrine of Equivalents.

I claim:

1. A sealable storage container, comprising:

a container bottom having an upstanding continuous sidewall which defines an aperture which allows access to the container bottom;

a container lid for mating cooperation with the container bottom, and which further has an aperture formed therein and which extends therethrough, and wherein the container lid has a top surface, which has a cavity formed substantially centrally thereof, and wherein the aperture is formed substantially centrally of the cavity;

a threaded shaft portion received in the aperture defined by the container lid;

a hand-engageable portion affixed to the threaded shaft portion and which rests within the cavity;

a moveable pressure plate threadably cooperating with the threaded shaft portion, and wherein a clockwise rotation of the threaded shaft portion moves the pressure plate in the direction of the container lid, and a counter-clockwise rotation of the threaded shaft portion moves the moveable pressure plate away from the container lid; and a resilient sealing member mounted on the moveable pressure plate and which extends in the direction of the container lid, and wherein the clockwise rotation of the threaded shaft portion causes the resilient sealing member to engage the container lid, and then deform, at least in part, laterally, outwardly so as to releasably, sealably engage the continuous sidewall of the container bottom to effect the sealable attachment of the container lid to the container bottom.

2. A sealable storage container as claimed in claim 1, and wherein the container bottom has a bottom surface which is defined by a peripheral edge, and wherein the upstanding continuous sidewall extends upwardly from the peripheral edge of the bottom surface.

3. A sealable storage container as claimed in claim 2, and wherein the container bottom has a uniform length dimension, and a non-uniform width dimension.

4. A sealable storage container as claimed in claim 3, and wherein the continuous sidewall is formed of a first pair of oppositely positioned, and substantially planar end walls, and a second pair of oppositely oriented, and non-planar sidewalls.

5. A sealable storage container as claimed in claim 4, and further comprising:

a plurality of orientation members each defining an internal channel and which are mounted to the container lid, and which extend downwardly therefrom; and a plurality of orientation posts mounted on the pressure plate, and which extend upwardly therefrom, and which are each matingly received in the respective channels defined by each of the orientation members so as to facilitate the linear and uniform movement of the pressure plate both towards, and away from, the container lid.

6. A sealable storage container as claimed in claim 1, and wherein the pressure plate has an outside peripheral edge, and the resilient sealing member has an inside peripheral edge which matingly and sealably engages the outside peripheral edge of the pressure plate, and wherein the resilient sealing member has an outside peripheral edge which extends laterally outwardly relative to the outside peripheral edge of the pressure plate and in the direction of the container lid.

7. A sealable storage container as claimed in claim 6, and wherein the pressure plate when threadably advanced toward the container lid, by the clockwise rotation of the threaded shaft portion, is effective in carrying the outside peripheral edge of the resilient seal into forceable engagement with the container lid so as to cause a portion of the resilient sealing member to deform, and then move laterally, outwardly and thereby sealably engage the upstanding, and continuous sidewall of the container bottom.

8. A sealable storage container, comprising:

a container bottom, defining a cavity, for receiving an object of interest, and wherein the container bottom includes a bottom surface with a peripheral edge, and a continuous sidewall which extends upwardly from the peripheral edge of the bottom surface, and which further has a top peripheral edge defining a container bottom aperture which allows the object of interest to be placed within the cavity of the container bottom, and wherein the bottom surface of the container bottom has a uniform length dimension, and a non-uniform width dimension, and wherein the non-uniform width dimension is generally intermediate the opposite ends thereof, and wherein the continuous sidewall is defined by a first pair of oppositely positioned, and planar end walls, and a second pair of oppositely positioned and non-planar sidewalls, and wherein the second pair of non-planar sidewalls each have a concavely shaped cavity formed therein, and which facilitates a user's handling of the sealable storage container;

a container lid for cooperating with the container bottom, and which further occludes the container bottom aperture, and wherein the container lid has a top, and bottom surface, and an aperture is formed therein, and which extends between the top and bottom surfaces, and wherein at least one orientation member is mounted on the bottom surface, and depends downwardly therefrom, and which further defines an internal channel, and wherein the top surface of the container lid has a cavity formed substantially centrally thereof, and wherein the aperture is formed substantially centrally of the cavity, and has a predetermined diametral dimension;

a rotatable member received within the aperture formed in the container lid, and wherein the rotatable member includes a threaded shaft portion extending through the aperture defined by the container lid, and a hand-engageable portion is affixed to the threaded shaft portion, and which rests at least in part, on the top surface of the container lid, and wherein the hand engageable portion of the rotatable member is received, at least in part, within the cavity formed in the top surface of the container lid;

a moveable pressure plate oriented in spaced relation relative to the bottom surface of the container lid, and wherein the moveable pressure plate has a top surface which is juxtaposed relative to the bottom surface of the container lid, an opposite bottom surface, and a peripheral edge, and wherein a threaded channel is mounted on the top surface of the moveable pressure plate and is sized so as to threadably receive and matingly cooperate with the threaded shaft of the rotatable member, and wherein the clockwise rotation of the rotatable member threadably advances the moveable pressure plate in the direction of the container lid, and the counter-clockwise rotation of the rotatable member effects movement of the moveable pressure plate away from the container lid, and wherein an orientation post is mounted on the top surface of the pressure plate, and is sized so as to be slideably received in the orientation member which is mounted on the bottom surface of the container lid; and a resilient, substantially continuous sealing member which has an inside peripheral edge which sealably engages the peripheral edge of the moveable pressure plate, and which further has an outside peripheral edge which extends in the direction of the bottom surface of the container lid, and wherein, the container lid, when placed in an occluding relationship relative to the aperture defined by the container bottom, and the rotatable member is rotated in a clockwise direction, the moveable pressure plate travels in the direction of the container lid, and causes the resilient, substantially continuous sealing member to forcibly engage the bottom surface of the container lid, and then resiliently deform, at least in part, substantially laterally and outwardly so as to sealably engage the continuous sidewall which defines, at least in part, the container bottom so as to effectively sealably secure the container lid to the container bottom.

9. A sealable storage container as claimed in claim 8, and wherein the outside peripheral edge of the resilient, substantially continuous sealing member deforms and moves laterally outwardly so as to sealably engage the continuous sidewall forming, at least in part, a portion of the container bottom when the rotatable member is rotated in a clockwise direction.

10. A sealable storage container as claimed in claim 9, and wherein the storage container may be easily disassembled so it can be inspected, washed and sanitized as required.

11. A sealable storage container as claimed in claim 9, and wherein the threaded channel mounted on the moveable pressure plate has an outside diametral dimension which is less than the diametral dimension of the aperture which is formed substantially centrally of the container lid.

12. A sealable storage container as claimed in claim 11, and wherein the aperture formed substantially centrally of the container lid is surrounded by an elevated neck portion, and the hand engageable portion of the rotatable member has an inside facing surface with a member which matingly engages the elevated neck portion surrounding the aperture.

* * * * *

UNITED STATES PATENT AND TRADEMARK OFFICE

CERTIFICATE OF CORRECTION

PATENT NO. : 8,403,166 B2
APPLICATION NO. : 13/134155
DATED : March 26, 2013
INVENTOR(S) : Jeff Steininger It is certified that error appears in the above-identified patent and that said Letters Patent is hereby corrected as shown below:

In the Specifications:

Column 4, line 23, replace "/22" with --22--.

Signed and Sealed this
Eighteenth Day of June, 2013

Teresa Stanek Rea
*Acting Director of the United States Patent and Trademark Office*